10/22/85 OR 4,548,366

United States Patent [19]

Wirz et al.

[11] Patent Number: 4,548,366

[45] Date of Patent: Oct. 22, 1985

[54] CHUCK DRIVE SYSTEM

[75] Inventors: Armin Wirz, Ossingen; Werner Nabulon, Ruedlingen, both of Switzerland

[73] Assignee: Rieter Machine Works, Ltd., Winterthur, Switzerland

[21] Appl. No.: 379,134

[22] Filed: May 17, 1982

[51] Int. Cl.[4] ..... B65H 54/02; B65H 54/40

[52] U.S. Cl. ..... 242/18 DD; 242/18 R; 242/45

[58] Field of Search ..... 242/18 DD, 18 R, 18 A, 242/45, 18 PW

[56] References Cited

U.S. PATENT DOCUMENTS

| | | | |
|---|---|---|---|
| 2,950,067 | 8/1960 | Keith | 242/18 DD |
| 3,288,383 | 11/1966 | Muller | 242/45 |
| 3,536,272 | 10/1970 | Ueyama | 242/45 |
| 3,917,182 | 11/1975 | Lenk | 242/18 DD X |
| 4,043,517 | 8/1977 | Jahrig | 242/18 DD |
| 4,069,985 | 1/1978 | Lohest | 242/45 |
| 4,307,848 | 12/1981 | Barathieu | 242/18 DD X |

*Primary Examiner*—Stanley N. Gilreath
*Attorney, Agent, or Firm*—Kenyon & Kenyon

[57] ABSTRACT

In a filament winding machine with a directly driven chuck and a friction roll which contacts the package during winding, the chuck is held spaced from the roll in an initial phase of winding so that first contact between a package and the roll is made by build-up of the package.

24 Claims, 8 Drawing Figures

CHUCK DRIVE SYSTEM

Figure 1:
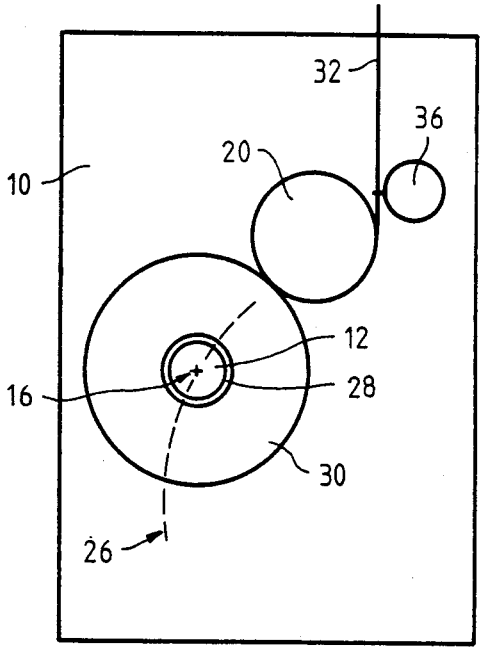

This invention relates to a machine for winding filament material into packages. The filament material may be a synthetic plastics material, e.g. polyester, polyamide or polypropylene. The filament material may be in the form of a monofilament or a multifilament structure, both of which types will hereinafter be referred to as a "thread".

PRIOR ART

It is currently common practice to form thread packages on a rotatable bobbin chuck, the drive for the packages, and hence the chuck, being derived from a friction drive roll contacting the circumference of the package—see for example U.S. Pat. No. 3,907,217. The speed of rotation of the package is a determinant for the speed at which thread is drawn into the package, which is vitally important to the spinning operation as it determines spinning conditions e.g. in the region of a spinneret from which a synthetic plastics thread is drawn and these in turn determine the characteristics of the thread. However, at speeds significantly higher than 5000 meters per minute, the slippage which occurs at the region of contact between the friction drive roll and the package becomes unacceptably high. Many proposals have therefore been made to drive the chuck directly during the winding operation and some of these proposals also retain the friction drive on the package surface, see for example U.S. Pat. Nos. 4,146,376 and 4,069,985, GB Pat. Nos. 944552 and 995185 and Japanese Published Patent Application No. 51-49026.

In the prior art, inadequate attention has been paid to the initial phases of the winding operation in which contact is first made between the friction drive roll and the package, bearing in mind that the speed of rotation of these parts may be extremely high.

PRESENT INVENTION

The present invention relates to a winding machine for winding thread into a package comprising a chuck upon which the package forms during a winding operation and means for driving the chuck into rotation about a chuck axis extending longitudinally thereof. Normally, the thread windings of the package are formed upon a bobbin tube which is removably mounted upon the chuck. In this specification, the term "package" includes the bobbin tube when the latter is used.

The winding machine further comprises a friction roll for contacting the circumference of the package during a winding operation, and a drive means for driving the roll into rotation about a roll axis extending longitudinally thereof. Means are provided for causing relative movement of the chuck and the roll towards and away from each other along a path extending generally transversely of both the chuck axis and the roll axis. The arrangement is, however, such that a space is left between the friction roll and the package at completion of the relative movement of the chuck and the friction with the friction roll is made by reason of build-up of the roll towards one another. Thus, initial contact of the package package and not by reason of the relative movement of the chuck and friction roll towards one another. Means, for example an abutment means, can be provided to limit relative movement of the chuck and friction roll towards one another so as to provide the spacing at the completion of such movement.

Control means may be provided for controlling the speed of rotation of each of the friction roll and the chuck. The control means may be conditionable, having a normal winding condition in which a feedback signal is provided from the friction roll for use in controlling the drive means for the chuck, and a starting condition in which no such signal is provided. The control system may be conditionable in response to sensing of initial contact of the package with the friction roll, e.g. switch means responsive to such contact may be provided to change the control system from the starting condition to normal winding condition.

The control means may be operable to control the circumferential force applied between the friction roll and a package engaged by the roll. Preferably the control means is adjustable so that such circumferential force can be selectively adjusted. For example, if the friction roll is driven by an asynchronous drive motor, that motor can be regulated to provide a controlled output drive moment (within certain limits dependent upon the motor design) independent of the speed of the friction roll, which will be seperately regulated, when the control means is in its normal winding condition, by a feedback loop containing the contact between friction roll and package.

The control means may control the drive means for the chuck in such manner that the speed of rotation of the package is matched to the speed of rotation of the friction roll when contact is first made between the package and the roll. The control means may also be arranged to vary the speed of rotation of the chuck in a predetermined manner during build-up of the package prior to contact thereof with the friction roll. Normally, the rotational speed of the chuck will be varied in such a manner as to maintain the tangential speed at the circumference of the package equal to or slightly higher than the thread-line speed.

The feedback signal provided from the friction roll to control the drive means for the chuck is preferably a signal representing the circumferential speed of the roll. Since the roll has a constant diameter throughout the winding process, the speed of rotation of the roll is related to its circumferential speed by a constant factor. The signal can be derived from a tachogenerator associated with the friction roll. Since the drive for the package is derived from both the drive means for the chuck and the drive means for the friction roll, slippage between the roll and package can be eliminated so that the feedback signal representing the circumferential speed of the friction roll simultaneously represents the circumferential speed of the package.

The winding machine may include a substantially conventional traverse mechanism for reciprocating the thread longitudinally of the chuck axis to enable build-up of the package. The machine may also include a conventional threading-up mechanism to enable initial laying of the thread onto a rotating chuck. The chuck may be of generally conventional construction, and can be provided with means for catching a thread laid thereon and severing the thread from the threading means.

Figure 8:
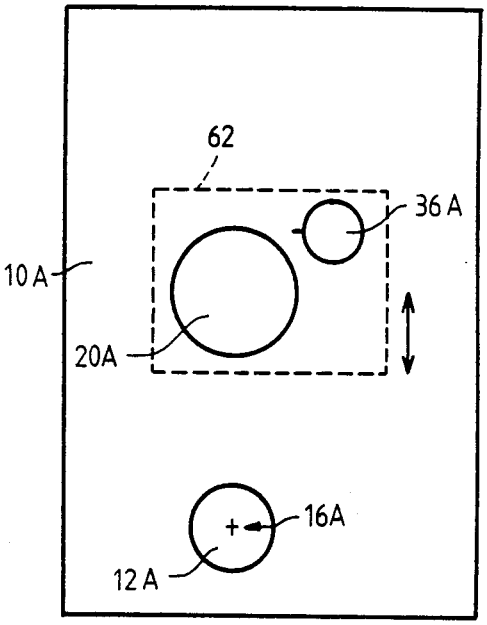
Figure 2:
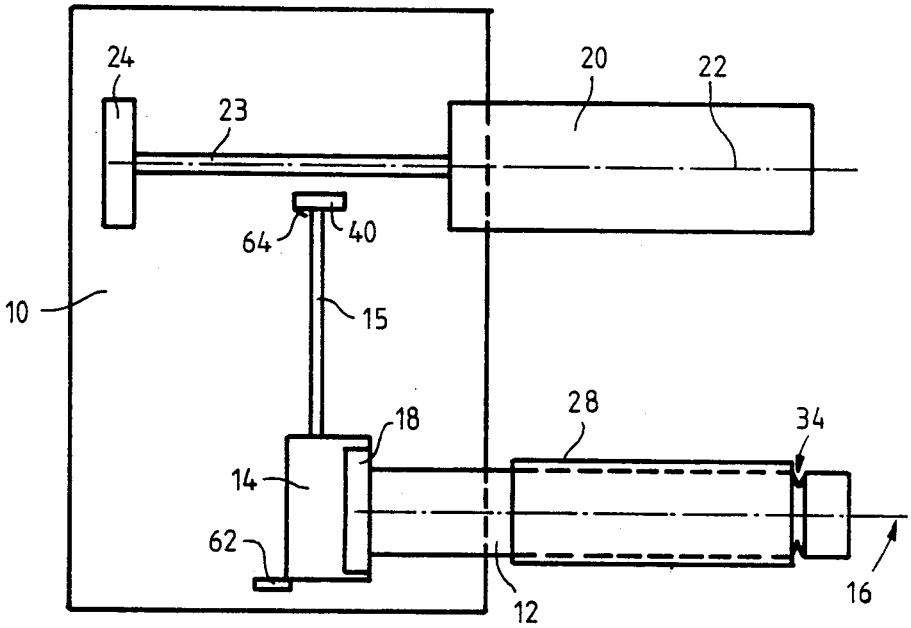
Figure 3:
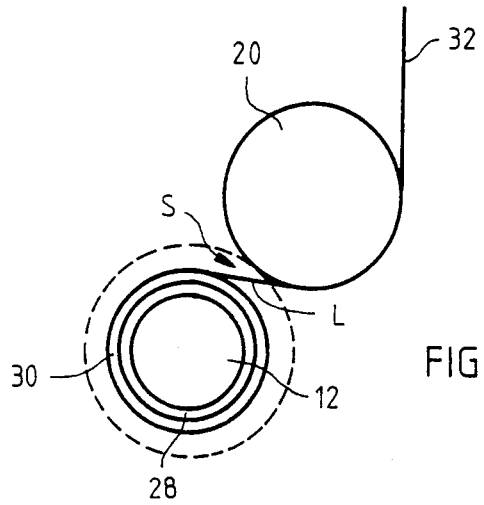
Figure 6:
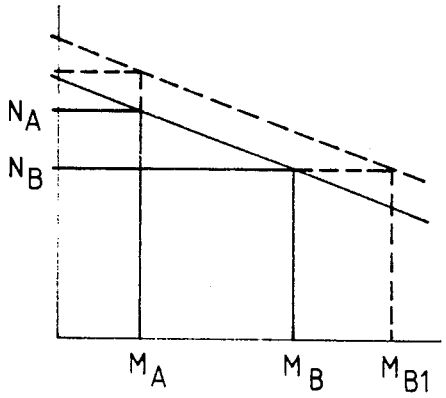
Figure 7:
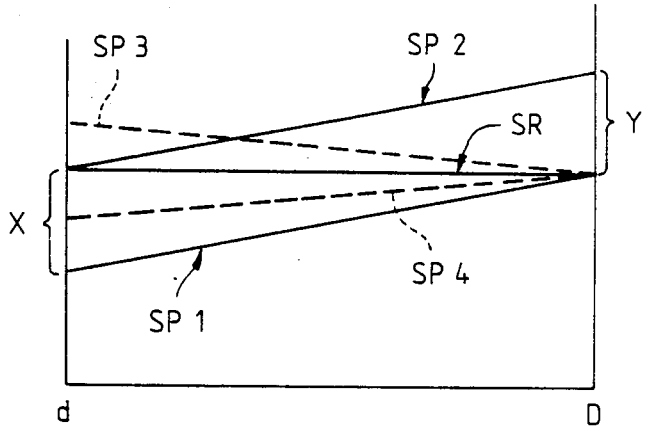
Figure 4:
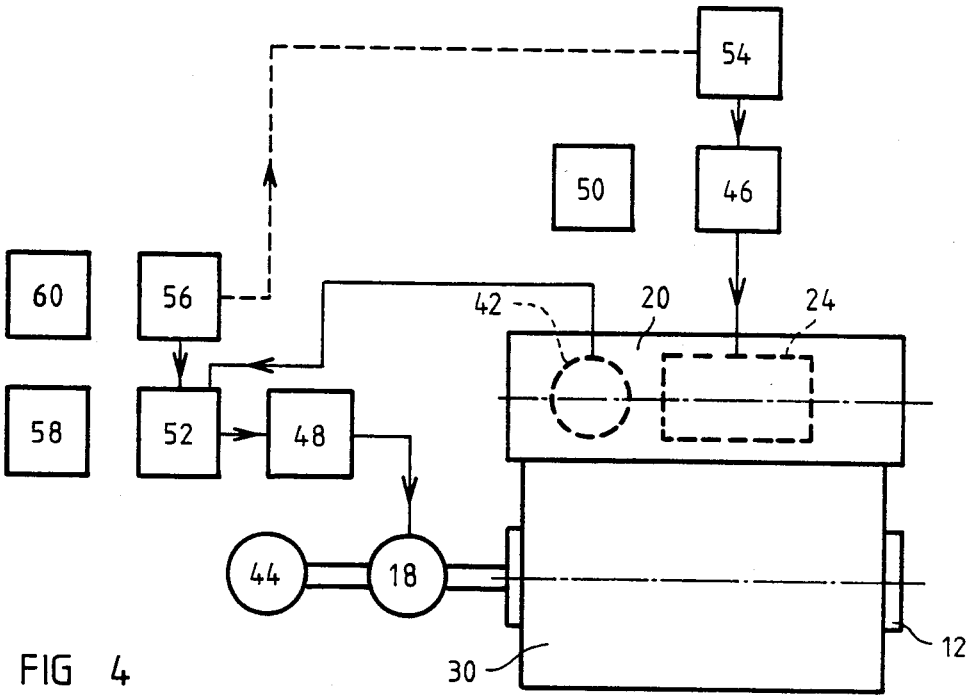
Figure 5:
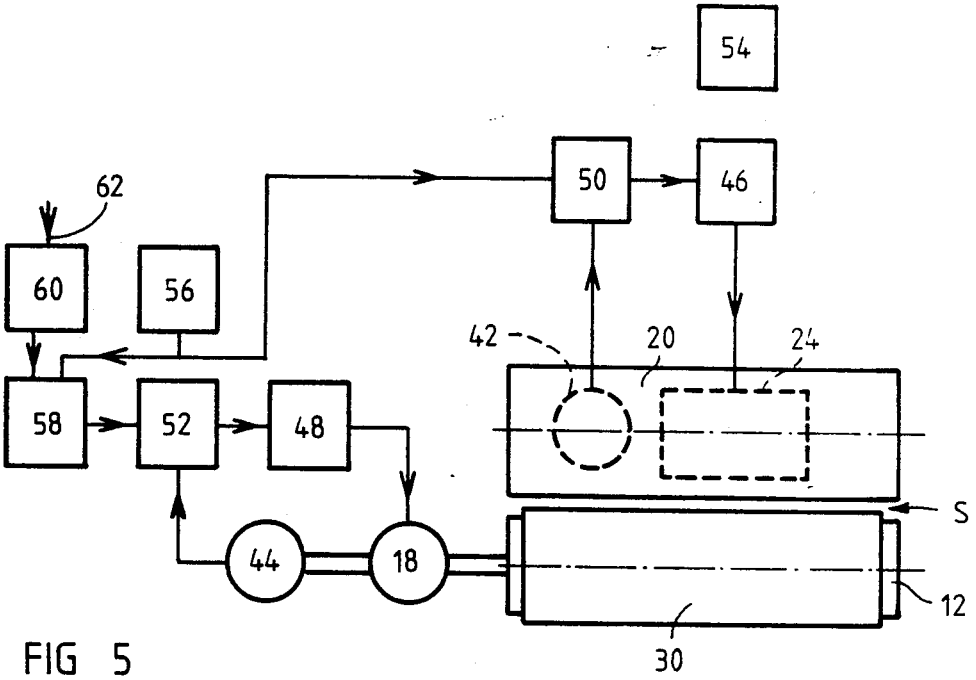

By way of example, embodiments of the invention will now be described with reference to the accompanying drawings, in which FIG. 1 is a diagrammatic front elevation of a machine in accordance with the invention, FIG. 2 is a diagrammatic side elevation of the same machine but with the parts in a different relative disposition, FIG. 3 is a diagram for use in explanation of the relationship between the package and the friction roll during the initial phase of the winding operation, FIGS. 4 and 5 are circuit diagrams for explanation of the control systems of the machine, FIG. 6 is a diagram for use in explanation of the circuit of FIG. 4, FIG. 7 is a diagram for use in explanation of the circuit of FIG. 5, and FIG. 8 is a diagrammatic front elevation of a further machine in accordance with the invention.

The machine shown diagrammatically in FIGS. 1 and 2 is a high-speed winder for thread of synthetic plastics filament. For ease of explanation and illustration, the machine will be described with reference to a single thread line only. However, as is well-known in this art, the machine may be adapted to handle a plurality of thread lines simultanesously. FIG. 1 shows the machine during a winding operation, whereas in FIG. 2 the machine is shown inoperative.

The machine comprises a frame and housing structure ("frame") 10 on and in which the other parts are mounted. A side plate of the housing is assumed to be removed in FIG. 2, to show the interior thereof. A chuck 12 is mounted on a carriage 14 to extend cantilever fashion from the front face of the frame 10. Chuck 12 is mounted on its carriage 14 in a manner permitting rotation of the chuck about longitudinal axis 16 thereof, and such rotation is produced by an electric motor 18 also mounted on the carriage 14. Motor 18 is of the asynchronous type.

Carriage 14 is mounted on the frame 10 for movement along guides 15 in response to extension/retraction of pressure fluid operated moving means such as a piston and cylinder unit (not shown). Carriage 14 thus moves chuck 12 towards and away from a friction roll 20. The latter is mounted in the frame 10 for rotation about its roll axis 22 (FIG. 2), which is fixed relative to the frame. Rotation of roll 20 about its axis 22 is produced by an asynchronous electric motor 24 which is fixedly mounted in the frame 10 and acts on the roll 20 via a drive shaft 23. As an alternative, schematically represented in FIGS. 4 and 5, the roll 20 can be constructed as an external rotor motor with a stator fixed to the frame and the rotor encircling the stator. Such motors are well known in this art.

Movement of chuck 12 towards and away from roll 20 involves movement of axis 16 along a curved path 26 as indicated in FIG. 1. At one end of the path 26, furthest spaced from roll 20, the chuck 12 has a rest position (also shown in FIG. 2). In this position, a bobbin clamping device (not shown) of conventional construction and built into the chuck structure 12 can be operated to clamp/release a bobbin 28 upon which thread windings 30 are formed during the winding operation to make-up a package.

As illustrated in FIG. 1, the winding machine is of the well-known "print friction" type in which a thread 32 passes around a portion of the circumference of the friction roll 20 before being transferred from the roll 20 to the thread windings 30. Before chuck 12 reaches the upper end of path 26 the operator passes thread 32 around the roll 20. When the chuck 12 reaches the upper end of path 26 and is rotating at the desired speed, the operator lays the thread on the chuck 12 where it will be caught by a conventional catching/severing mechanism 34 (FIG. 2) and transferred to the bobbin 28 to begin formation of thread windings thereon. During formation of the thread windings 30, the thread is reciprocated longitudinally of the chuck axis 16 by means of a conventional traverse mechanism 36 (FIG. 1) provided up-stream of the friction roll 20. Although not illustrated in the present drawings, the machine may include a conventional threading-up mechanism for automatically laying the thread upon the chuck 12, e.g. as shown in U.S. Pat. No. 4,136,834. Conventional mechanisms may also be provided for forming a tail-winding upon the bobbin 28 prior to commencement of the main thread windings 30, the tail-winding serving to enable knotting of one package to another during further use of the thread.

Immediately after completion of the threading-up operation, chuck 12 remains at the end of path 26 nearest to the friction roll 20. This is the condition shown in full lines in FIG. 3, from which it can be seen that there is still a space S remaining between the circumference of the windings 30 which have already formed upon the bobbin 28 and the circumference of the friction roll 20. The radial thickness of the windings 30 at this stage of the winding operation has been exaggerated for clarity of illustration in FIG. 3. The spacing S is determined by the position of a stop 40 (FIG. 2) against which the carriage 14 strikes at the extremity of the guide 15. Because of the space S, a length of thread L extends freely between friction roll 20 and windings 30 at this stage of the winding operation. The friction roll 20 is at this time rotated by the motor 24 so that the circumferential speed of the roll 20 is equal to the thread line speed required for the thread being produced.

Chuck 12 while rotating remains stationary at the upper end position of its path 26 as shown in FIG. 3 until the package builds up sufficiently to fill the space S and therefore to engage the circumference of the friction roll 20 (as shown in dotted lines in FIG. 3). From this stage on, further build-up of the package must be accompanied by return movement of the chuck 12 along its path 26 towards the rest position shown in FIG. 2. Such movement is effected under the control of the carriage moving means (not shown) such that a controlled contact pressure is maintained between the surface of the package and the surface of the roll, as is well-known in this art.

A control means or system for controlling the winding speed is shown in a normal winding condition in FIG. 4 and in a starting condition in FIG. 5. The starting condition is maintained from the time that the thread is first laid on the chuck until contact is made between the windings 30 and friction roll 20. The control system is then switched to the condition shown in FIG. 4 which is maintained until the windings 30 have reached the desired diameter, at which time the winding operation is broken off either in response to an automatic means for sensing the length of thread wound (for example by reference to package diameter) or in response to manual operation of a push button. Carriage 14 then quickly returns chuck 12 to the rest position where rotation of the chuck 12 is brought to a halt, and the bobbin clamping device is released to permit removal of the full package and replacement thereof by an empty bobbin. The winding cycle can then be repeated.

The normal winding condition of the control system will first be described with reference to the circuit configuration shown in full lines in FIG. 4. In this condition, contact has been made between the windings 30 and the friction roll 20 so that driving force can be transmitted between them. As will become clear from the following description, the driving force may be transmitted either from the friction roll to the package, or vice versa. For the present, it will be assumed that the friction roll 20 is applying drive force to the package.

The control system comprises a tacho generator 42 coupled to the rotor or drive shaft 23 (FIG. 2) of the roll 20, a tacho generator 44 coupled to the drive shaft of the chuck 12, an invertor 46 for feeding the friction roll motor 24, an invertor 48 for feeding the chuck motor 18, a regulator 50 for regulating the output of the invertor 46, a regulator 52 for regulating the output of the invertor 48, a setting device 54 operable to set the output of the invertor 46, a setting device 56 for providing a setting value to the regulator 52, an auxiliary setting device 58 and a timer 60 for a purpose to be described.

In the circuit configuration shown in FIG. 4, regulator 52 is receiving the output of its setting device 56 and also the output of the tacho generator 42. Regulator 52 compares the inputs from setting device 56 and generator 42 and provides an output to the invertor 48 in dependence upon this comparison. Invertor 48 supplies a corresponding input to the motor 18 to control the speed of rotation of the latter. Assuming that there is no slippage at the region of contact between the windings 30 and the roll 20, the tangential speed of the windings in the contact zone will be equal to the tangential speed of the roll 20. Since the diameter of the roll 20 is constant throughout the winding operation, this tangential speed is represented directly by the output of the tacho generator 42. Regulator 52 acts via invertor 48 to hold the output from generator 42 constant at a value set by the setting device 56, that is regulator 52 effectively holds the speed of rotation of friction roll 20 constant throughout the portion of the winding process for which the FIG. 4 circuit is effective. Since the diameter of the package is steadily increasing throughout the winding operation, this will necessitate gradual reduction of the speed of rotation of motor 18 and chuck 12 throughout the winding operation. In this circuit configuration, tachogenerator 44, device 58 and timer 60 play no part in the control operation.

Motor 24 meanwhile receives an input from its own invertor 46. This input is determined directly by the setting device 54 which for this purpose is connected directly to the invertor 46, bypassing the regulator 50. The effect of variation of the setting of device 54 can be seen from the diagram in FIG. 6, which is provided for purposes of explanation only and does not necessarily represent the preferred arrangement which will be further discussed later.

The curve shown in full lines in FIG. 6 represents the characteristic of output speed N (vertical axis) against output drive moment M (horizontal axis) for the motor 24. Setting device 54 determines the synchronous speed at which the curve of the motor characteristic crosses the vertical axis i.e. where the drive moment M would equal zero. Under "no load" conditions, that is, if the motor 24 were driven by the invertor 46 as shown in FIG. 4 but without contact between roll 20 and the package, motor 24 would drive the roll at speed $N_A$ with output moment $M_A$. Under the given load conditions, that is with contact between roll 20 and the package, assume that the speed of motor 24 is $N_B$; the output moment will then be $M_B$. The speed $N_B$ will be the speed determined by the feedback loop comprising tacho generator 42, regulator 52, invertor 48, motor 18 and the package building on chuck 12.

The drive moment $M_B$-$M_A$ is applied by the roll to the package and is dependent on the setting device 54. Thus, if the setting device 54 is adjusted to raise the synchronous speed of the motor 24, then the motor characteristic is shifted upwards, e.g. to the dotted line curve shown in FIG. 6. The "no load" drive moment $M_A$ remains the same but, assuming that there is no change in the desired rotational speed $N_B$, the on load output moment of motor 24 will be raised to the value $M_{B1}$ so that motor 24 is applying additional tangential force to the circumference of the package. There is a corresponding change in the electrical slip in motor 24.

It will be appreciated that setting device 54 can be arranged to provide any desired tangential force (i.e. rotational force) to the circumference of the package within certain physical limits. These limits are imposed in part by the conditions in the contact zone where, e.g. a very high circumferential force applied from the roll to the package will simply lead to slip between those parts, thereby defeating the purpose of the feedback loop. The limits are also imposed by the construction of motor 24 actually selected for a particular machine. The electrical slip tolerable in a given motor is dependent on the motor construction and limits the drive moment range obtainable from the motor. Within the given limits, the setting of device 54 can be adjusted as required by practical conditions. The setting device 54 can be set so that motor 24 applies no net tangential force to the package. Setting device 54 could also be adjusted to cause roll 20 to brake the package, or to apply a circumferential (tangential) force which varies in a predetermined desired manner throughout the normal winding operation.

Reference will now be made to the circuit configuration shown in FIG. 5. The control system is in this condition from the start of a winding cycle (i.e. from the time that the chuck leaves its rest position), throughout the period during which a spacing S (FIG. 3) is present between the thread windings 30 and the roll 20 until contact has been made between the windings 30 and the roll. The step of changing condition from the FIG. 5 to the FIG. 4 configuration will be described in further detail later. In the FIG. 5 condition, invertor 46 receives its drive input from the regulator 50, and setting device 54 has no controlling function. The output of tacho generator 42 is now passed to regulator 50, which also receives a setting input from the setting device 56. Roll 20 is therefore rotated by motor 24 at the speed set by device 56.

The rotation speed of motor 18 cannot, of course, be governed by reference to the output from generator 42, because there is no physical contact between the package and roll 20. The regulator 52 therefore now receives an input from tacho generator 44 which measures directly the speed of rotation of the motor 18. The setting input for regulator 52 is not, derived directly from setting device 56, for reasons which will now be explained by reference to the diagram in FIG. 7. This diagram relates tangential speed at the package circumference (vertical axis) to package diameter (horizontal axis). The vertical axis is set at package diameter d substantially equal to the external diameter of the bobbin 28. A vertical line appears on the diagram at package diameter D at which contact is made between the package and the circumference of roll 20. The circumferential speed of roll 20, as set by device 56 and controlled by means of the tacho generator 42, is indicated by the horizontal line SR.

Consider now the circumferential speed of the package during build up of package diameter from d to D. The arrangement could be such that this speed follows the line SP 1 which can be attained by feeding an appropriate constant setting value from setting device 56 to the regulator 52. If this arrangement is adopted, the circumferential speeds of the package and roll will be equal when they contact each other (intersection of lines SP 1 and SR at package diameter D). However, the circumferential speed of the package at diameter d will be less than the value SR by an amount X which is dependent upon the difference D−d and the angular velocity which must be set for the motor 18 to produce the circumferential speed SR at package diameter D. The speed SR for the friction roll should be equal to the linear thread line speed. Accordingly the lower circumferential package speed at package diameter d must be associated with a loss of thread tension in the thread length L between the friction roll 20 and the thread windings 30 in FIG. 3. If this loss of tension is too large, the result will be poor windings in this initial portion of the package. This in turn will lead to difficulties in withdrawal of thread from the package during further processing.

As an alternative, package circumferential speed could be arranged to follow the line SP 2, also by feeding a constant setting value to the control circuit for motor 18 during this starting phase. In this case, the circumferential package speed would already equal the thread line speed at package diameter d. However, package circumferential speed would exceed the thread line speed by an amount Y at package diameter D. If the amount Y is too large, the net result will be a shock on the system at the time of contact of the thread windings with the roll 20. Apart from possible damage to the thread, the change in output of generator 42 arising from the shock, together with switching of the system to the normal winding condition shown in FIG. 4, will result in transients on one or both of the feedback loops shown in FIGS. 4 and 5. These transients will at least produce hunting in the control loops, and may even lead to instability thereof.

A preferable characteristic for the circumferential package speed is shown in dotted line at SP 3. The package speed is slightly higher than the thread line speed at package diameter d but declines to be substantially equal to the thread line speed, and the circumferential speed of roll 20, at package diameter D. The slightly increased tension in the free length L shown in FIG. 3, caused by the relatively high package circumferential speed at package diameter d, gives a good package build at this starting phase. The matching of the package circumferential speed to the roll circumferential speed at package diameter D avoids the shock problems referred to above.

The characteristic SP 3 cannot, however, be obtained by supplying a constant setting value to the regulator 52; this value must be continuously changed over the period for which the package diameter is increasing from d to D, and for this purpose the auxiliary setting device 58 is used. Device 58 is responsive to a timer 60 which can be initiated upon receipt of a signal on input 62 to start "counting down". This initiating signal is supplied at the moment when the thread starts winding upon the bobbin 28, i.e. at package diameter d, and it can be derived, for example, from the threading-up system indicating transfer of the thread from the latter system to the chuck. Timer 60 is set to count down at a predetermined rate over a period equal to the time necessary for the package to build from diameter d to diameter D; this time must be determined in dependence upon the operating conditions including the thread line speed, the initial spacing between the package and the roll 20, the thread titer and the package length. Timer 60 provides an output to setting device 58 which contains stored data representing a sequence of setting values for the regulator 52. Device 58 feeds out successive values of the sequence in dependence upon receipt of count down signals from timer 60.

The setting values supplied to regulator 52 effectively control the rotation velocity of motor 18, gradually reducing that velocity as the package diameter increases. The final setting value of the sequence stored in device 58 must produce a rotation velocity of motor 18 giving a package circumferential speed equal or very nearly equal to SR at package diameter D; this value is therefore related to the setting value provided by setting device 56, which can be coupled to the device 58 as indicated in FIG. 5. Device 58 may contain a range of data of which only part of the range will be required for given circumstances, the sequence data selected from the range being dependent upon the setting inserted at the device 56.

The data stored in device 58 should also be capable of dealing with different starting diameter "d" since bobbin and chuck diameters can vary from one set of circumstances to another. This starting point in the sequence should therefore be settable independently of regulator 56 and timer 60.

It must be understood, however, that the characteristics shown in FIG. 7 represent "idealised" operations. Since there is no feedback from the package circumference, it must be assumed that the package is in fact building up in the required manner during this starting phase—direct control is exerted only over the rotation speed of motor 18. Accordingly, the starting phase is preferably kept short, that is, the initial spacing S is kept small, so that the feedback loop from the package circumference is established as soon as reasonably possible.

It will also be understood that it is not necessary to follow the idealised form of characteristic SP 3 shown in FIG. 7. It is important that the circumferential speed of the package should be matched to the circumferential speed of the roll 20 to an extent adequate to avoid undue shock effects as referred to above. The extent of matching necessary will therefore be dependent upon the shock effects which are tolerable in the system. At the optimum, the circumferential speeds of the package and roll are exactly equal at contact. Further, it is important that the package circumferential speed at diameter d should be high enough to avoid poor package formation through loss of tension in the free length L. The actual speed required for this purpose will be dependent upon many factors, and can be determined empirically for the individual case. For example, in some circumstances, a circumferential speed of the package lower than the thread line speed may be tolerable and the characteristic SP 4 shown in dotted line may be perfectly acceptable in that case. In any event, the speed adjustment during the starting phase may be discontinuous rather than continuous as shown in the diagram.

It should be specifically noted that the circumferential speed of the friction roll is held constant (at the desired threadline speed) from start to end of the winding operation, that is, with the control means in both its FIG. 4 and FIG. 5 configurations. This implies that the motor 24 must run at the same speed under both load (FIG. 4) and "no-load" (FIG. 5) conditions as discussed above with reference to FIG. 6, i.e. $N_A = N_B$. The construction of motor 24 must permit appropriate settings, that is appropriate infeed from invertor 46. In electrical terms, the motor must be operable over a sufficiently wide range of electrical slip to cover the designed load and no-load conditions.

It is of course desirable to avoid not only "speed shocks" at the time of contact of the package with the friction roll, but also "drive shocks" at the time of switching of the control circuit from the starting to the normal condition. At the time of switching, contact will have been made between the package and the roll. Upon such contact, the output of invertor 46 will change to maintain the output of tacho generator 42 constant (constant speed of roll 20) despite the change in operating conditions caused by contact of the package and roll. Setting device 54 must be arranged to maintain the output of invertor 46 constant at the value it adopted before switching occurred. This must normally be determined empirically and the setting of device 54 chosen accordingly.

Device 54 may be designed to apply only a predetermined correction factor to a setting inserted at setting device 56. This arrangement is illustrated schematically by the dotted line connection shown in FIG. 4. On the other hand, it is not essential that the setting device 56 should be coupled to the device 58 as shown in FIG. 5. The two devices can be set independently. The timer 60 is preferably adjustable to enable varying count down rates and varying count down periods. Device 58 may be programmable to enable adjustment of the variable sequence in dependence upon varying factors of use.

The control system may be arranged to adopt its starting condition automatically when the chuck 12 arrives in its rest position, for example, in response to operation of a position sensor 62 (FIG. 2). The control system is therefore in the starting condition during movement of the chuck axis along the path 26, and during the acceleration of motor 18 to its "starting" speed prior to threading up. The illustrated circuits can be coupled with conventional start-up control circuits (not shown) which will cause regulator 52 to bring motor 18 to the desired "starting" speed i.e. the speed selected for package diameter d. The control system remains in the starting condition (circuit configuration of FIG. 5) throughout the period for which the chuck axis is held stationary at the upper end of path 26 (FIG. 1). The continued presence of the chuck in this position is registered by a second position sensor 64 which is built-into the stop 40 to be engaged by the carriage 14 (FIG. 2). Sensor 64 registers the movement of chuck axis 16 away from the friction roll 20 due to build-up of the package following contact thereof with the roll. Switching means (not shown) is provided to change the circuit configuration of FIG. 5 to that of FIG. 4 in response to registration of the start of this return movement by the position sensor 64. Sensor 64 is for example an electrical switch operable in response to very small movements of carriage 14 in the return direction to operate a relay which in turn causes the change in circuit configuration. There is inevitably a short delay between establishment of contact between package and roll, and the change in configuration of the control means. This delay is preferably held as short as possible.

The initial spacing S (FIG. 3) is preferably maintained as small as practically possible while avoiding risk of contact between the package and the roll in response to operation of the pressure fluid cylinder means 17. A spacing of approximately 1 millimeter (mm) will normally be found adequate in practice, the spacing being grossly exaggerated in FIG. 3 for purpose of clarity of illustration. The chuck axis 16 is preferably held stationary in the end position on its path 26 while build-up of the package takes up this initial spacing S.

The invention is not limited to generation of a feedback signal by means of a tacho generator. Alternative systems are known for obtaining a feedback signal representing circumferential speed of a roller contacting a driven package. However, a tacho generator represents a convenient and economic method of generating the required signal.

The description of the timer 60 and device 58 assumed that the timer is a digital counter and that the data stored in device 58 is in the form of a sequence of discrete setting values. This is not necessary. The device can be adapted to operate in an analog fashion, e.g. by gradual adjustment of a potentiometer, the output voltage of which represents the setting input to regulator 52. The starting signal for the timer 60, fed in on input 62 (FIG. 5), is best derived from the threading up system. Such systems commonly employ one or more thread guides arranged to perform a predetermined movement around the chuck circumference to lay threads on the chuck. The motive power for such movement may be manual or may be automatically controlled. In either case, the starting signal can be produced automatically at a predetermined stage of the movement of the guides, for example, the completion of such movement.

The system has been described for a "print friction" winder. It is equally applicable to a winder in which the thread is passed directly to the package i.e. with no, or no appreciable, angle of wrap about the friction roll. In this case, the speed of the friction roll has no direct effect upon the thread line speed similar to that of a print friction roll. However, the requirements of speed matching to avoid introducing instability into the control system remain.

The system has also been described for a machine having a single chuck 12 and in which the winding operation is temporarily terminated while the chuck is returned to its rest position, full packages are doffed and new bobbin tubes are donned. The invention is not limited to this type of machine. Machines having multiple chucks which are brought successively to a winding position to enable substantially "wasteless" winding are well known and the invention is equally applicable to them. In particular, the invention is applicable to the automatic winder described in co-pending U.S. patent application Ser. No. 412,014, filed Aug. 25, 1982 and Ser. Nos. 411,708 and 411,908 each filed Aug. 26, 1982.

The system has been described in the context of a machine in which relative movement of the chuck and friction roll is obtained by moving the chuck relative to a fixed roll. This is also not essential. FIG. 8 shows in highly schematic form a machine in which the friction roll 20A is movable relative to a fixed chuck 12A. The numerals used in FIG. 8 correspond where possible with those used in FIG. 1. The roll 20A and traverse mechanism 36A are mounted on a carriage 62 which is vertically reciprocable towards and away from the chuck 12A. The axis 16A of the latter is fixed relative to the frame 10A. A stop (not shown), corresponding to the stop 40 of FIG. 2, halts carriage 62 at a position such that a spacing is left between roll 20A and a bobbin carried by chuck 12A. No differences are required in the electrical circuits and hence further explanation is believed unnecessary.

The control elements 42 to 62 inclusive shown in FIGS. 4 and 5 have been treated collectively as a single "control means" which is capable of being switched from one condition to another in response to contact between the package and the friction roll. As shown in FIGS. 4 and 5, the two control "modes" employ common control elements 42, 46, 48, 52—possibly also 56. It is clear however that there may be no common control elements for the two control modes. Seperate "blocks" could be provided and the system could switch from one block to the other in a changing mode. The two blocks are, in such a case, still to be considered as part of single "control means"—the "conditioning" then comprising the step of switching from one block to the other.

In the specification and claims, reference is made to control of "speed of rotation" of a part, or to "circumferential speed" of a part. It will be appreciated that such control can be effected by reference to quantities directly related to the controlled quantity and by action upon parameters causally connected with the controlled quantity. The specification and claims are therefore not to be read as limited to direct sensing of the controlled quantity or to control by direct action upon the part to be affected.

We claim:

1. A winding machine for winding thread into a package comprising:

at least one chuck for supporting a thread package;

a motor connected to said chuck for driving the chuck into rotation about a longitudinal chuck axis;

a friction roll for contacting the circumference of a thread package on said chuck;

means for driving said roll into rotation about a longitudinal roll axis;

means or causing relative movement of said chuck and said roll towards and away from each other along a path extending generally transversely of said axes; and means independent of said motor for limiting said relative movement of said chuck and said roll towards each other to leave a space between said chuck and said roll at completion of said relative movement of said chuck and said roll towards each other.

2. A winding machine as claimed in claim 1 wherein the means for limiting said relative movement is a stop.

3. A winding machine as claimed in claim 1 wherein said space is approximately 1 millimeter.

4. A winding machine for winding thread into a package comprising;

at least one chuck for supporting a thread package;

first means for driving the chuck into rotation about a longitudinal chuck axis;

a friction roll for contacting the circumference of a thread package on said chuck;

second means for driving said roll into rotation about a longitudinal roll axis;

means for producing a feed back signal representative of the speed of said friction roll; and control means for controlling the speed of rotation of said chuck in response to said feed back signal and for selectively adjusting the rotational force applied between said friction roll and a package on said chuck, said control means including a first adjustable setting device connected to said first means and operable to set a predetermined circumferential speed for said package and said roll, and a second adjustable setting device connected to said second means and operable selectively to adjust said second means to correspondingly adjust the rotational force applied between said friction roll and a package on said chuck.

5. A winding machine as claimed in claim 4 wherein said means for driving said friction roll comprises an asynchronous motor, said second adjustable setting device selectively adjusting the speed of said synchronous motor to thereby adjust said rotational force.

6. A winding machine for winding thread into a package comprising:

at least one chuck for supporting a thread package;

means for driving the chuck into rotation about a longitudinal chuck axis;

a friction roll spaced from said chuck for contacting the circumference of a thread package being wound on said chuck;

means for driving said roll into rotation about a longitudinal roll axis;

control means for controlling the speeds of rotation of each of said friction roll and said chuck, said control means being conditionable to have a normal winding condition in which a feedback signal is provided from said friction roll to control said means for driving said chuck and a starting condition in which no such signal is provided and said friction roll is spaced from a package being wound on said chuck; and conditioning means to change the condition of said control means from said starting condition to said normal winding condition in response to contact of said friction roll with a thread package being wound on said chuck.

7. A winding machine as claimed in claim 6 wherein said control means is operable in said starting condition to control said speeds of rotation of the friction roll and said chuck individually and to match said speeds at said time of contact of the friction roll with a thread package on said chuck.

8. A winding machine as claimed in claim 6 wherein said control means includes means for varying the speed of rotation of the chuck in a predetermined manner while said control means is in said starting condition.

9. A winding machine as claimed in claim 8 wherein said control means comprises means operable to match the rotational speed of the package to the speed of said friction roll at the time of contact therebetween.

10. A winding machine as claimed in claim 9 wherein said control means is operable in said starting condition to cause rotation of said friction roll at contant speed and to cause rotation of said chuck in such manner that the rotational speed of the package is reduced during winding of a package prior to contact with said friction roll.

11. A winding machine as set forth in claim 6 wherein said control means includes selectively adjustable means for adjusting the rotational force supplied between said friction roll and the package wound on said chuck.

12. A winding machine as claimed in claim 6 wherein said conditioning means is responsive to separation of said chuck and said friction roll due to build-up of a package following contact between said roll and the package.

13. A winding machine as claimed in claim 12 wherein said conditioning means is a position sensing member.

14. A winding machine as claimed in claim 13 wherein said position sensing member is adapted to sense the position of said chuck on a predetermined path of movement thereof.

15. A winding machine as claimed in claim 6 wherein said control means comprises means to produce an output signal dependent upon the speed of rotation of said friction roll, said output signal providing said feed back signal when said control means is in said normal winding condition and said output signal being used by said control means to control the speed of said friction roll when said control means is in said starting condition.

16. A winding machine as claimed in claim 6 wherein said control means comprises means to produce an output signal dependent upon the speed of rotation of said chuck, said control means bieng responsive in said starting condition to said output signal to control said means for driving said chuck.

17. A winding machine as claimed in claim 16 wherein said control means comprises a regulator for controlling said drive means for said chuck, said regulator being responsive to said output signal when said control means is in said starting condition and being responsive to said feedback signal when said control means is in normal winding condition.

18. A winding machine as claimed in claim 17 wherein said control means includes means for varying the speed of said chuck in a predetermined manner while said control means is in said starting condition, said latter means including means for feeding a variable input to said regulator while said control means is in said starting position.

19. A winding machine as claimed in claim 6 wherein said control means is selectively adjustable when in said normal winding condition to adjust the rotational force applied between said friction roll and a package on said chuck.

20. A method of winding thread comprising the steps of:

laying a thread upon a driven rotating chuck to form a package thereon while controlling the speed at which the thread is drawn into the package by controlling the speed of rotation of the chuck;

causing a partially-formed package on the chuck to contact an independently driven friction roll in such manner that the circumferential speed of the friction roll equals the circumferential speed of the package at the time of contact, and thereafter maintaining the speed of the friction roll at a set value to control the speed at which the thread is drawn into the package.

21. A method as claimed in claim 20 comprising the step of controlling the speed of the chuck in such manner that the circumferential speed of the package is made equal to the circumferential speed of the friction roll at the time of contact.

22. A method as claimed in claim 21 including the step of controlling the speed of the chuck in such manner that the circumferential speed of the package is reduced during winding of the package prior to contact with the friction roll.

23. A method as claimed in claim 22 including the step of controlling the speed of the package to hold the speed of the friction roll constant after contact with the package at a speed equal to the speed of the friction roll before contact with the package.

24. A method as claimed in claim 20 comprising the steps of controlling the speed of the chuck and the speed of the friction roll by conditionable control means which changes from a first condition driving the chuck and the friction roll independently of each other to a second condition driving the chuck and the friction roll in dependence on each other in response to contact of the package with the friction roll, and causing the circumferential force applied by the friction roll to the package after said change to said second condition to be equal to the circumferential force applied by the friction roll to the package before said change to said second condition.

* * * * *

UNITED STATES PATENT AND TRADEMARK OFFICE

CERTIFICATE OF CORRECTION

PATENT NO. : 4,548,366

DATED : October 22, 1985

INVENTOR(S) : Armin Wirz and Werner Nabulon

It is certified that error appears in the above-identified patent and that said Letters Patent is hereby corrected as shown below:

Column 1, lines 61 to 63 change "friction with ... the package"-- to -friction roll towards one another. Thus, initial contact of the package with the friction roll is made by reason of build-up of the--

Column 11, line 44 change "means or" to - means for-

Column 12, line 51 change "of the chuck" to -of said chuck-

Signed and Sealed this

*Twenty-second* Day of *April 1986*

[SEAL]

*Attest:*

DONALD J. QUIGG

*Attesting Officer*

*Commissioner of Patents and Trademarks*